US006309565B1

(12) United States Patent
Stowell et al.

(10) Patent No.: US 6,309,565 B1
(45) **Date of Patent: *Oct. 30, 2001**

(54) FORMALDEHYDE-FREE FLAME RETARDANT TREATMENT FOR CELLULOSE-CONTAINING MATERIALS

(75) Inventors: Jeffrey K. Stowell, Ramsey, NJ (US); Edward D. Weil, New York, NY (US); William L. Coble, Burlington, NC (US); Charles Q. Yang, Athens, GA (US)

(73) Assignees: Akzo Nobel NV (NL); The University of Georgia Research Foundation, Inc., Athens, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/406,529

(22) Filed: Sep. 27, 1999

(51) Int. Cl.[7] ..... C09K 21/12; D06M 13/192; D06M 13/292

(52) U.S. Cl. ..... 252/608; 252/8.62; 252/8.86; 8/127.1; 57/904

(58) Field of Search ..... 252/608, 8.62, 252/8.86; 8/127.1; 57/904

(56) References Cited

U.S. PATENT DOCUMENTS

| | | | | |
|---|---|---|---|---|
| 3,695,925 | * | 10/1972 | Weil . | |
| 4,199,534 | * | 4/1980 | Fearing | 521/169 |
| 4,268,633 | * | 5/1981 | Fearing | 521/168 |
| 4,335,178 | * | 6/1982 | Fearing | 428/253 |
| 4,404,313 | | 9/1983 | Leitner | 524/512 |
| 4,443,903 | | 4/1984 | Leitner | 5/459 |
| 4,444,831 | | 4/1984 | Leitner | 428/262 |
| 4,820,307 | | 4/1989 | Welch et al. | 8/120 |
| 4,936,865 | | 6/1990 | Welch et al. | 8/120 |
| 4,975,209 | | 12/1990 | Welch et al. | 252/8 |
| 5,116,890 | * | 5/1992 | Floyd et al. | 524/50 |
| 5,199,953 | | 4/1993 | Fung et al. | 8/120 |
| 5,221,285 | | 6/1993 | Andrews et al. | 8/127.1 |
| 5,246,904 | * | 9/1993 | Hois et al. | 502/203 |
| 5,252,663 | * | 10/1993 | Chandran et al. | 524/813 |
| 5,447,537 | * | 9/1995 | Choi | 8/115.6 |
| 5,496,476 | | 3/1996 | Tang et al. | 252/8.6 |
| 5,695,528 | | 12/1997 | Komori et al. | 8/127.1 |
| 5,705,475 | | 1/1998 | Tang et al. | 510/513 |

FOREIGN PATENT DOCUMENTS

| | | | |
|---|---|---|---|
| 97/31036 | 8/1997 | (WO) | C08F/8/30 |
| 98/30387 | 7/1998 | (WO) | B32B/23/08 |

OTHER PUBLICATIONS

Chemical Abstracts, vol. 96, 21257m (1982).
Chemical Abstracts, vol. 78, 45004f (1973).
"Flame Retardants (Phosphorus)", Kirk–Othmer Encyclopedia of Chemical Technology, Fourth Edition, vol. 10, pp. 988–989 and 996–997 (1993).
A.R. Horrocks, "Flame–Retardant Finishing of Textiles", Rev. Prog. Coloration, vol. 16, pp. 62–101 (1986).

* cited by examiner

*Primary Examiner*—Joseph D. Anthony
(74) *Attorney, Agent, or Firm*—Richard P. Fennelly

(57) ABSTRACT

An aqueous finishing composition for cellulose-containing materials, comprising a hydroxyalkyl-functional organophosphorus flame retardant (which contains a substantially non-volatile component at the curing temperature) and a non-formaldehyde cross-linking agent (such as a polycarboxylic acid cross-linking agent), and the materials treated with such a composition. Optional ingredients for the aqueous finishing composition include a cross-linking catalyst and/or an inexpensive saturated alpha-hydroxy polycarboxylic acid such as citric acid (partial replacement of a more expensive preferred polycarboxylic acid will reduce finishing costs).

19 Claims, No Drawings

FORMALDEHYDE-FREE FLAME RETARDANT TREATMENT FOR CELLULOSE-CONTAINING MATERIALS

BACKGROUND OF THE INVENTION

The present invention relates to a formaldehyde-free flame retardant treatment for cellulose-containing materials, such as cotton or cotton blends (e.g., cotton/polyester and cotton/nylon), which is durable to both laundering and dry cleaning operations.

There are currently several different types of chemical finishes that can be applied to cellulose-containing materials to impart flame retardant (FR) properties. Of these systems, only a few create finished fabrics that can be laundered and dry-cleaned without losing their FR qualities. These treatments are generally referred to as durable FR finishes. Of these finishes, the most pertinent to the current invention are PROBAN and the PYROVATEX brand materials. The PROBAN technology, from Albright & Wilson, is based on the use of tetrakis-(hydroxymethyl)phosphonium chloride ("THPC")—based products and an ammoniation chamber. It is described in detail in the following U.S. Pat. Nos. 4,078,101; 4,145,463) 4,311,855 and 4,494,951, all to Albright and Wilson. The PYROVATEX CP methodology, originally developed by Ciba-Geigy, utilizes dimethyl (N-hydroxymethylcarbamoyl-ethyl)phosphonate or a similar methylol-functional phosphorus-containing analogue as the flame retardant agent. Given the market share that PROBAN and PYROVATEX products control in the industry, it is often difficult to understand the widespread tolerance of the negative aspects associated with the use of these products and the various chemistries they employ.

There have been several versions of the THPC cross-linking chemistry used over the years. For example, the precondensate-$NH_3$ process (e.g., PROBAN) technology is the most recent of these versions. Although this may be the most durable treatment on the market, this technology involves the use of an ammoniation chamber and strict application conditions to obtain consistent results without significant strength loss to the fabric. In addition to difficult application conditions, the startup costs for implementing this finishing technique and the regulatory issues associated with aimmonia gas make it less than attractive, especially for new arrivals to the market.

In many ways, the PYROVATEX technology suffers from much the same sort of downfalls as the PROBAN technology. Whether it is the original PYROVATEX CP methodology, based on the use of dimethyl (N-hydroxymethylcarbamoyl-ethyl)phosphonate, or other methods using different N-methylol-functional phosphorus-containing analogs, all of the products contain and emit the toxic component formaldehyde (a known carcinogen). In addition to the molecule forming the basis of the PYROVATEX-type approach, a formaldehyde-containing cross-linking resin, such as a N-methylolurea (for example, 1,3-dimethylol-4,5-dihydroxyethyleneurea—"DMDHEU"), N-methylolamide, or N-methylolmelamine, is also required to ensure adequate durability of the chemical finish. These resins are also independently used as durable-press cross-linking agents in the textile industry. The combination of a N-methylol phosphorus-containing analog and a N-methylol cross-linking resin, or the use of either reagent separately, often leads to the release of significant amounts of formaldehyde both during fabric application and throughout the lifetime of the garment. As a result, formaldehyde emission levels are limited and closely regulated throughout the industry. The only reason formaldehyde emissions are still tolerated is due to the lack of an acceptable formaldehyde-free replacement technology.

Given the negative impact of formaldehyde on human health, it has been a primary focus of the cotton apparel and textile finishing industries to create equivalent non-formaldehyde technologies. Accounting for their widespread use, most of the current research effort has been spent on the creation and design of new formaldehyde-free cross-linking agents for cellulose-containing materials. These reagents could be used in many different applications, ranging from use in durable-press finishes to general fixation additives for products such as the PYROVATEX-type FR additives. In the past several years, research efforts have led to the discovery of several new low formaldehyde based systems. These finishes are generally based on the structural modification of DMDHEU, either via substitution or elimination of the pendant methylol functionality. Nevertheless, these new finishing agents have never gained widespread acceptance due to their inadequate performance as cross-linking agents. In general, removal or modification of the most reactive aspect of the DMDHEU molecule has only resulted in the generation of less reactive and less desirable finishing agents.

In addition to modifying DMDHEU, other technologies have also begun to develop. One of the more promising non-formaldehyde systems is based on the use of polycarboxylic acids. These molecules create a cross-linked cellulosic material via the in-situ generation of five-membered cyclic anhydrides and their subsequent reaction with hydroxyl moieties contained within the treated textile. This technology was developed at the United States Department of Agriculture in New Orleans under the direction of Clark Welch and was based on the use of 1,2,3,4-butanetetracarboxylic acid (BTCA). Representative patents describing this approach are: U.S. Pat. Nos. 4,820,307; 4,936,865; 4,975,209; and 5,221,285.

Since the invention of the BTCA technology, additional investigators have begun to work with polycarboxylic acids to improve their commercial attractiveness. Some of the recent work has focused on the use of polymaleic acid and in some cases citric acid or combinations containing citric acid. Polymaleic acid (PMA) is an inexpensive, commercially available material commonly used as a water treatment chemical. Some aspects of this work are described in PCT International Patent Publication No. WO 98/30387. In addition to PMA, there is a wide range of alternative non-formaldehyde cross-linking resins that can be used in creating durable non-formaldehyde FR treatments for cellulose-containing materials. Many of these resins are currently available and used in the water treatment business for scale-inhibition, some of which even contain small amounts of phosphorus. The utilization of these formaldehyde-free, phosphorus-containing resins may even offer additional advantages over the phosphorus-free cross-linking resins such as PMA. Incorporation of phosphorus species into the cross-linking resin itself may eliminate the need for an external cross-linking catalyst and/or the added phosphorus may result in improved FR properties of the treated cellulose-containing materials. Examples of these resins can be seen in the following U.S. Pat. Nos. 4,046,707; 4,105,551; 4,621,127; 5,376,731; 5,386,038; 5,496,476; 5,705,475; and 5,866,664.

SUMMARY OF THE PRESENT INVENTION

The present invention relates to an aqueous finishing composition for cellulose-containing materials and the materials treated with such a composition. The aqueous finishing composition, in its broadest embodiment, comprises a hydroxyalkyl-functional organophosphorus flame retardant and a non-formaldehyde cross-linking agent, optionally with a cross-linking catalyst also being included therein.

DESCRIPTION OF THE PREFERRED EMBODIMENTS

The aqueous finishing composition, which is intended to be used to treat cellulose-containing materials in accordance with the present invention contains two essential components: (1) a hydroxyalkyl-functional organophosphorus flame retardant (excluding N-methylol, ethers thereof, and potentially formaldehyde releasing reagents); and (2) a non-formaldehyde cross-linking agent.

Monomeric, oligomeric (which generally contain from about two to ten repeat units) and polymeric (which generally contain over about ten repeat units) hydroxyalkyl-functional organophosphorus flame retardant additives are intended for use herein.

A reactive oligomeric phosphorus-containing flame retardant of the type that is described in U.S. Pat. No. 3,695,925 to E. D. Weil and U.S. Pat. Nos. 4,199,534, 4,268,633, and 4,335,178 to R. B. Fearing is an example of one of the hydroxyalkyl-functional organophosphorus flame retardants that can be used in accordance with the present invention. A preferred embodiment has the following structure:

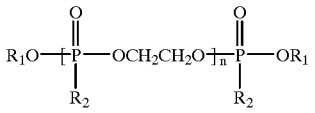

where $R_1$ is independently selected from methyl and hydroxyethyl, $R_2$ is independently selected from methyl, methoxy, and hydroxyethoxy, and n is equal to or greater than 1. This embodiment is made by a multistep process from dimethyl methylphosphonate, phosphorus pentoxide, ethylene glycol, and ethylene oxide and is available under the registered trademark FYROL® 51 from Akzo Nobel Chemicals Inc. The endgroups are principally hydroxyl groups.

Another class of materials for use herein includes water soluble oligomeric alkenylphosphonate materials, examples of which are described in U.S. Pat. Nos. 3,855,359 and 4,017,257, both to E. D. Weil. The presence of alkenyl substituents in these materials provide an additional mechanism for permanence utilizing free radical curing conditions (described in the patents above). A preferred species of this type was available under the trademark PYROL® 76 from Akzo Nobel Chemicals Inc. and is produced by reacting bis(2-chloroethyl) vinylphosphonate and dimethyl methylphosphonate with the substantial elimination of methyl chloride.

Another type of hydroxyalkyl-functional organophosphorus flame retardant that can be employed are oligomeric phosphoric acid esters that carry hydroxyalkoxy groups as described in U.S. Pat. Nos. 2,909,559, 3,099,676, 3,228,998, 3,309,427, 3,472,919, 3,767,732, 3,850,859, 4,244,893, 4,382,042, 4,458,035, 4,697,030, 4,820,854, 4,886,895, 5,117,033, and 5,608,100.

The flame retardant is generally present at from about 1% to about 60%, preferably from about 10% to about 40%, by weight of the aqueous finishing composition.

The non-formaldehyde cross-linking agent, which is the second essential component of the aqueous finishing composition of the present invention, is generally present at from about 1% to about 40%, by weight, of the total weight of that composition, preferably from about 5% to about 20%.

Polycarboxylic acid cross-linking agents form one type of cross-linking agent for use herein. The polycarboxylic acids effective as cellulose cross-linking agents in regard to this invention include aliphatic, alicyclic and aromatic acids either olefinically saturated or unsaturated with at least three and preferably more carboxyl groups per molecule or with two carboxyl groups per molecule if a carbon-carbon double bond is present alpha, beta to one or both carboxyl groups. An additional requirement is that to be reactive in esterifying cellulose hydroxyl groups, a given carboxyl group in an aliphatic or alicyclic polycarboxylic acid should be separated from a second carboxyl group by no less than two carbon atoms and no more than three carbon atoms. In an aromatic acid, a carboxyl group must be ortho to a second carboxyl group if the first carboxyl is to be effective in esterifying cellulosic hydroxyl groups. It appears from these requirements that for a carboxyl group to be reactive, it should be able to form a cyclic 5- or 6-membered anhydride ring with a neighboring carboxyl group in the polycarboxylic acid molecule. Where two carboxyl groups are separated by a carbon-carbon double bond or are both connected to the same ring, the two carboxyl groups should be in the cis configuration relative to each other if they are to interact in this manner. The aliphatic or alicyclic polycarboxylic acid may also contain an oxygen or sulfur atom in the chain or ring to which the carboxyl groups are attached.

In aliphatic acids containing three or more carboxyl groups per molecule, a hydroxyl group attached to a carbon atom alpha to a carboxyl group does not interfere with the esterification and cross-linking of cellulose by the acid. However, the presence of the hydroxyl group may cause a noticeable yellowing of the material during the heat cure. Such an alpha-hydroxy acid is suitable for durable press finishing of suitably dyed cotton fabric, since the color of the dye conceals the discoloration that may be caused by the presence of the hydroxyl group. Fabric discoloration is similarly observed with an unsaturated acid having an olefinic double bond that is not only alpha, beta to one carboxyl group but also beta, gamma to a second carboxyl group.

The discoloration produced in a white cellulose-containing material by cross-linking it with an alpha-hydroxy acid such as citric acid can be removed by impregnating the discolored material with an aqueous solution containing from 0.5% to 5% by weight of a decolorizing agent selected from the group consisting of magnesium monoperoxyphthalate, sodium perborate, sodium tetraborate, boric acid, sodium borohydride, sodium hypochlorite, and hydrogen chloride. The material is immersed in the solution of decolorizing agent and soaked for 5 to 120 minutes at ambient temperature or if necessary in such a solution warmed to a temperature not exceeding 60° C. The material is subsequently rinsed with water to remove excess chemicals and solubilized colored products, and then is dried.

A particularly preferred polycarboxylic acid cross-linking agent for use herein is 1,2,3,4-butanetetracarboxylic acid.

Another preferred polycarboxylic acid cross-linking agent for use herein is polymaleic acid.

Another embodiment for this component is a hydrolyzed terpolymer of maleic anhydride with vinyl acetate and ethyl acrylate. The molar ratio of maleic anhydride to the combined moles of vinyl acetate and ethyl acrylate is preferably from about 2.5:1 to about 5:1 and the molar amount of vinyl acetate to ethyl acrylate is preferably from about 1:4 to about 4:1, most preferably from about 1:2 to about 2:1. The molecular weight of the terpolymer has an upper limit of about 4,000. A product of this type is available under the trademark BELCLENE 283 from FMC Corporation.

Examples of other specific polycarboxylic acids which fall within the scope of this invention are the following: maleic acid; citraconic acid also called methylmaleic acid; citric acid also known as 2-hydroxy-1,2,3-propanetricarboxylic acid; itaconic acid also called methylenesuccinic acid; tricarballylic acid also known as 1,2,3,-propanetricarboxylic acid; trans-aconitic acid also known as trans-1-propene-1,2,3-tricarboxylic acid; 1,2,3,4-butanetetracarboxylic acid; all-cis-1,2,3,4-cyclopentanetetracarboxylic acid; mellitic acid also known as benzenehexacarboxylic acid; oxydisuccinic acid also known as 2,2'-oxybis-(butanedioic acid); thiodisuccinic acid; the phosphorus-containing polycarboxylic acid resins described in U.S. Pat. Nos. 4,046,707; 4,105,551; 4,621,127; 5,376,731; 5,386,038; 5,496,476; 5,705,475; 5,866,664; and the like.

In the event that adequate cross-linking is not accomplished using the previously mentioned systems, it may be necessary to add a suitable cross-linking catalyst to enhance the reaction between the cellulose-containing material which is to be treated, the hydroxyalkyl-functional organophosphorus flame retardant, and the non-formaldehyde cross-linking agent. This catalyst can be present at up to about 30 wt % of the total weight of the aqueous finishing composition, preferably up to about 10%. Examples of suitable catalyst types to select, as set forth in PCT International Patent Publication No. WO 98/30387 and U.S. Pat. Nos. 4,820,307, 4,936,865, 4,975,209, and 5,221,285 include one or more of the alkali metal salts of the known hypophosphite, phosphite, pyrophosphate, dihydrogen phosphate, phosphate, and hydrogen phosphate species, and such acids as one or more of the polyphosphoric, hypophosphorous, phosphorous, and alkyl phosphinic acids. Alternative basic cross-linking catalysts such as $NaHCO_3$ and $Na_2CO_3$ can also be used.

In some cases, in order to raise the pH of the treating solution to improve compatibility of the bath or additives and/or for improved strength retention, a portion of the polycarboxylic acid may be used in salt form, especially as a water soluble salt. Suitable for this purpose are alkali metal salts of the acid. Alternatively, or in combination with use of the polycarboxylic acid in salt form, the pH of the treating solution may be raised, or the solution partially neutralized, by the addition of a base, preferably a water soluble base, such as an alkali metal hydroxide, ammonium hydroxide, or an amine. The pH may be elevated for such purpose to about 2.3 to about 5, preferably about 2.5 to 4.

The present invention is further illustrated by the Examples that follow.

EXPERIMENTAL BACKGROUND

Flame Retardant ("FR") Additives Used

Sample Compound #1: Modified FYROL® 51 Flame Retardant (low OH#)

Sample Compound #2: PEEOP (low OH#)

Sample Compound #3: Modified PEEOP (high OH#)

Sample Compound #4: FYROL® 51 Flame Retardant (high OH#)

Sample Compound #5: FYROL® 6 Flame Retardant

Sample Compound #6: FYROL® 76 Flame Retardant

In the listing given above, "PEEOP" is a poly(ethyl ethyleneoxy) phosphate of the type described in U.S. Ser. No. 08/677,283, having a molecular weight of around 915 (number average)/1505 (weight average), and a typical hydroxyl number of under about 5 mg KOH/g (low hydroxyl number version) and about 150 mg KOH/g (high hydroxyl number version). The modified FYROL® 51 flame retardant has a hydroxyl number of under about 5 mg KOH/g and the high hydroxyl version of the FYROL® 51 brand product has a hydroxyl number of about 125 mg KOH/g. The FYROL® 6 flame retardant has a hydroxyl number of about 440 mg KOH/g whereas the FYROL® 76 flame retardant has a hydroxyl number of about 100 mg KOH/g.

Polycarboxylic Acid Resins and Other Chemicals Used

Belclene 283: a 35% aqueous solution of the hydrolysis product of a terpolymer (TMPA) of maleic anhydride, vinyl acetate, and ethyl acrylate.

Belclene 200: a 35% aqueous solution of polymaleic acid (PMA).

BTCA: 1,2,3,4-butanetetracarboxylic acid (solid).

$NaH_2PO_2$ (hydrate): used as a cross-linking catalyst.

Equipment Used

Pad Applicator (laboratory size): an instrument used to apply a solution to fabric at a specified level (% wet-pickup).

Curing Oven (laboratory size): an oven that is used to dry and subsequently cure chemically treated fabrics at high temperatures.

Washing Machine (household size): used for laundering (with Tide® detergent) fabrics before and after chemical treatment and curing.

Fabric Used

Medium weight (about 1am thick), white, prewashed, 100% cotton fabric (12×16 inch samples).

Experimental Details

Preliminary Work:

The cotton fabric was laundered to ensure its cleanliness, and then cut into about 12×16 inch samples for subsequent use. Using water and fabric samples, the pad applicator was set to a wet-pickup of about 75% (additional weight of the liquid divided by the original weight of the dry cloth). A 75% wet-pickup of water translated to about 80% wet-pickup for the chemical solutions.

General Procedure:

The application solutions with and without FR were prepared. Each solution contained a FR (except blanks), polycarboxylic acid, $NaH_2PO_2$, and water. Given a wet-pickup of 80%, the solution concentrations were adjusted to give the desired add-on weights of each chemical.

After preparation, each application solution was used within a period of five hours.

Each solution was then applied to a fabric sample. The fabric was immersed in the solution, fed through the pad applicator, immersed in the solution again, and fed through the pad applicator again to ensure adequate homogeneity throughout the fabric sample.

After application, each fabric sample was placed on a metal frame and inserted into the oven at 80° C. to dry (three to five minutes).

After drying, each sample was placed in the oven again at 180° C. to cure the chemical treatment (one and one half to two minutes).

Each cured sample was then removed from the metal rack and its physical properties recorded. Any observations made while drying and curing the fabric were also recorded.

Informal Ignition Tests:

Each fabric sample was held in a horizontal position and ignited with a propane lighter. The flamability properties of each fabric sample were recorded.

EXPERIMENTAL DATA

1st Trial Application:

| | BELCLENE 283 Resin | | | BTCA | | |
|---|---|---|---|---|---|---|
| | Sample Comp. #2 | Sample Comp. #4 | Sample Comp. #5 | Sample Comp. #2 | Sample Comp. #4 | Sample Comp. #5 |
| Dry Add-On Weight | 10% FR#2 4% TMPA 2% $NaH_2PO_2$ | 10% FR#4 4% TMPA 2% $NaH_2PO_2$ | 10% FR#5 4% TMPA 2% $NaH_2PO_2$ | 10% FR#2 4% BTCA 2% $NaH_2PO_2$ | 10% FR#4 4% BTCA 2% $NaH_2PO_2$ | 10% FR#5 4% BTCA 2% $NaH_2PO_2$ |
| Application Solution Recipe | 26.6 g FR#2 30.4 g BELCLENE 283 5.4 g $NaH_2PO_2$ 137.6 g $H_2O$ | 26.6 g FR#4 30.4 g BELCLENE 283 5.4 g $NaH_2PO_2$ 137.6 g $H_2O$ | 26.6 g FR#5 30.4 g BELCLENE 283 5.4 g $NaH_2PO_2$ 137.6 g $H_2O$ | 26.6 g FR#2 10.7 g BTCA 5.4 g $NaH_2PO_2$ 157.3 g $H_2O$ | 26.6 g FR#4 10.7 g BTCA 5.4 g $NaH_2PO_2$ 157.3 g $H_2O$ | 26.6 g FR#5 10.7 g BTCA 5.4 g $NaH_2PO_2$ 157.3 g $H_2O$ |
| Drying Conditions | 3 min. @ 80° C. | 3 min. @ 80° C. | 3 min. @ 80° C. | 3 min. @ 80° C. | 3 min. @ 80° C. | 3 min. @ 80° C. |
| Curing Conditions | 1.5 min. @ 180° C. | 1.5 min. @ 180° C. | 1.5 min. @ 180° C. | 1.5 min. @ 180° C. | 1.5 min. @ 180° C. | 1.5 min. @ 180° C. |
| Burn (before washing) | Bad - fabric burned | Bad - fabric burned | Bad - fabric burned | Bad - fabric burned | Bad - fabric burned | Bad - fabric burned |

2nd Trial Application:

| | Blank Samples (without FR) | | |
|---|---|---|---|
| | BELCLENE 283 (TMPA) | BTCA | BELCLENE 200 (PMA) |
| Dry Add-On Weight | 8% TMPA 4% $NaH_2PO_2$ | 8% TMPA 4% $NaH_2PO_2$ | 8% TMPA 4% $NaH_2PO_2$ |
| Application Solution Recipe | 57.1 g BELCLENE 283 10.0 g $NaH_2PO_2$ 132.9 g $H_2O$ | 57.1 g BELCLENE 283 10.0 g $NaH_2PO_2$ 132.9 g $H_2O$ | 57.1 g BELCLENE 283 10.0 g $NaH_2PO_2$ 132.9 g $H_2O$ |
| Drying Conditions | 5 min. @ 80° C. | 5 min. @ 80° C. | 5 min. @ 80° C. |
| Curing Conditions | 2 min. @ 180° C. | 2 min. @ 180° C. | 2 min. @ 180° C. |
| Burn Test (before wash) | Bad - fabric burned | Bad - fabric burned | Bad - fabric burned |
| Fabric Color | Slight off-white tint | White | Yellow tint |
| Fabric Hand | Very hard | Hard | Very hard |
| Other Observations | No smoke | No smoke | No smoke |

| | Sample Comp. #1 | Sample Comp. #2 | Sample Comp. #3 | Sample Comp. #4 | Sample Comp. #5 | Sample Comp. #6 |
|---|---|---|---|---|---|---|
| | BELCLENE 283 Resin (TMPA) | | | | | |
| Dry Add-On Weight | 20% FR#1 8% TMPA 4% $NaH_2PO_2$ | 20% FR#2 8% TMPA 4% $NaH_2PO_2$ | 20% FR#3 8% TMPA 4% $NaH_2PO_2$ | 20% FR#4 8% TMPA 4% $NaH_2PO_2$ | 20% FR#5 8% TMPA 4% $NaH_2PO_2$ | 20% FR#6 8% TMPA 4% $NaH_2PO_2$ |
| Application Solution Recipe | 50.0 g FR#1 57.1 g BELCLENE 283 10.0 g $NaH_2PO_2$ 82.9 g $H_2O$ | 50.0 g FR#2 57.1 g BELCLENE 283 10.0 g $NaH_2PO_2$ 82.9 g $H_2O$ | 50.0 g FR#3 57.1 g BELCLENE 283 10.0 g $NaH_2PO_2$ 82.9 g $H_2O$ | 50.0 g FR#4 57.1 g BELCLENE 283 10.0 g $NaH_2PO_2$ 82.9 g $H_2O$ | 50.0 g FR#5 57.1 g BELCLENE 283 10.0 g $NaH_2PO_2$ 82.9 g $H_2O$ | 50.0 g FR#6 57.1 g BELCLENE 283 10.0 g $NaH_2PO_2$ 82.9 g $H_2O$ |
| Drying Conditions | 5 min. @ 80° C. | 5 min. @ 80° C. | 5 min. @ 80° C. | 5 min. @ 80° C. | 5 min. @ 80° C. | 5 min. @ 80° C. |
| Curing Conditions | 2 min. @ 180° C. | 2 min. @ 180° C. | 2 min. @ 180° C. | 2 min. @ 180° C. | 2 min. @ 180° C. | 2 min. @ 180° C. |
| Burn Test (before wash) | Good | Good | Good | Good | Bad - fabric burned | Good |
| Burn Test (after 1 | Acceptable | Bad - fabric | Good | Good | Bad - fabric | Good |

-continued

| | | | | | | |
|---|---|---|---|---|---|---|
| | | | EXPERIMENTAL DATA | | | |
| water wash) | | burned | | | burned | |
| Burn Test (after 5 launderings) | — | — | Acceptable | Good | — | Acceptable |
| Fabric Color | Pink color | Dark pink color | Pink color | Dark pink color | Pink color | Light pink tint |
| Fabric Hand | Hard | Soft | Very hard | Very hard | Very hard | Very hard |
| Other Observations | Smoked during cure | Solubility problem-FR | No smoke | No smoke | Smoked during cure | No smoke |
| | | | BTCA | | | |
| Dry Add-On Weight | 20% FR#1 5% BTCA 2.5% $NaH_2PO_2$ | 20% FR#2 5% BTCA 2.5% $NaH_2PO_2$ | 20% FR#3 5% BTCA 2.5% $NaH_2PO_2$ | 20% FR#4 5% BTCA 2.5% $NaH_2PO_2$ | 20% FR#5 5% BTCA 2.5% $NaH_2PO_2$ | 20% FR#6 5% BTCA 2.5% $NaH_2PO_2$ |
| Application Solution Recipe | 50.0 g FR#1 12.5 g BTCA 6.3 g $NaH_2PO_2$ 131.2 g $H_2O$ | 50.0 g FR#2 12.5 g BTCA 6.3 g $NaH_2PO_2$ 131.2 g $H_2O$ | 50.0 g FR#3 12.5 g BTCA 6.3 g $NaH_2PO_2$ 131.2 g $H_2O$ | 50.0 g FR#4 12.5 g BTCA 6.3 g $NaH_2PO_2$ 131.2 g $H_2O$ | 50.0 g FR#5 12.5 g BTCA 6.3 g $NaH_2PO_2$ 131.2 g $H_2O$ | 50.0 g FR#6 12.5 g BTCA 6.3 g $NaH_2PO_2$ 131.2 g $H_2O$ |
| Drying Conditions | 5 min. @ 80° C. | 5 min. @ 80° C. | 5 min. @ 80° C. | 5 min. @ 80° C. | 5 min. @ 80° C. | 5 min. @ 80° C. |
| Curing Conditions | 2 min. @ 180° C. | 2 min. @ 180° C. | 2 min. @ 180° C. | 2 min. @ 180° C. | 2 min. @ 180° C. | 2 min. @ 180° C. |
| Burn Test (before wash) | Good | Good | Good | Good | Bad - fabric burned | Good |
| Burn Test (after 1 water wash) | Acceptable | Bad - fabric burned | Good | Good | Bad - fabric burned | Good |
| Burn Test (after 5 launderings) | — | — | Good | Good | — | Good |
| Fabric Color | White | White | White | White | Slight yellow tint | White |
| Fabric Hand | Semi-soft | Soft | Hard | Very hard | Hard | Very hard |
| Other Observations | Smoked during cure | Solubility problem-FR | No smoke | No smoke | Smoked during cure | No smoke |

| | BELCLENE 200 (PMA) | | | |
|---|---|---|---|---|
| | Sample Comp. #1 | Sample Comp. #3 | Sample Comp. #4 | Sample Comp. #6 |
| Dry Add-On Weight | 20% FR#1 8% PMA 4% $NaH_2PO_2$ | 20% FR#3 8% PMA 4% $NaH_2PO_2$ | 20% FR#4 8% PMA 4% $NaH_2PO_2$ | 20% FR#6 8% PMA 4% $NaH_2PO_2$ |
| Application Solution Recipe | 50.0 g FR#1 57.1 g BELCLENE 200 10.0 g $NaH_2PO_2$ 82.9 g $H_2O$ | 50.0 g FR#3 57.1 g BELCLENE 200 10.0 g $NaH_2PO_2$ 82.9 g $H_2O$ | 50.0 g FR#4 57.1 g BELCLENE 200 10.0 g $NaH_2PO_2$ 82.9 g $H_2O$ | 50.0 g FR#6 57.1 g BELCLENE 200 10.0 g $NaH_2PO_2$ 82.9 g $H_2O$ |
| Drying Conditions | 5 min. @ 80° C. | 5 min. @ 80° C. | 5 min. @ 80° C. | 5 min. @ 80° C. |
| Curing Conditions | 2 min. @ 180° C. | 2 min. @ 180° C. | 2 min. @ 180° C. | 2 min. @ 180° C. |
| Burn Test (before wash) | Good | Good | Good | Good |
| Burn Test (after 1 water wash) | Acceptable | Good | Good | Good |
| Burn Test (after 5 launderings) | — | — | Good | — |
| Fabric Color | Yellow tint | Yellow tint | Yellow tint | Yellow tint |
| Fabric Hand | Hard | Very hard | Hard | Very hard |
| Other Observations | Smoked during cure | No smoke | No smoke | No smoke |

3rd Trial Application:

| | Sample Compound #5 | | |
|---|---|---|---|
| | BELCLENE 283 (TMPA) | BTCA | BELCLENE 200 (PMA) |
| Dry Add-On Weight | 40% FR#5 8% TMPA | 40% FR#5 5% BTCA | 40% FR#5 8% PMA |

-continued

| EXPERIMENTAL DATA | | | |
|---|---|---|---|
| | 4% $NaH_2PO_2$ | 2.5% $NaH_2PO_2$ | 4% $NaH_2PO_2$ |
| Application Solution Recipe | 100.0 g FR#5<br>57.1 g BELCLENE<br>283<br>10.0 g $NaH_2PO_2$<br>32.9 g $H_2O$ | 100.0 g FR#5<br>12.5 g BTCA<br>6.3 g $NaH_2PO_2$<br>81.2 g $H_2O$ | 100.0 g FR#5<br>57.1 g BELCLENE<br>200<br>10.0 g $NaH_2PO_2$<br>32.9 g $H_2O$ |
| Drying Conditions | 5 min. @ 80° C. | 5 min. @ 80° C. | 5 min. @ 80° C. |
| Curing Conditions | 2 min. @ 180° C. | 2 min. @ 180° C. | 2 min. @ 180° C. |
| Burn Test (after 1 water wash) | Bad - fabric burned | Bad - fabric burned | Bad - fabric burned |
| Fabric Color | Yellow tint | Yellow tint | Yellow tint |
| Fabric Hand | Soft | Soft | Soft |
| Other Observations | Smoked during cure | Smoked during cure | Smoked during cure |

Analysis of Selected Fabric Samples

Sample Compound #3 (20% add-on) with TMPA and BTCA (samples—before washing, after one water wash, and after five launderings).

Sample Compound #4 (20% add-on) with TMPA, BTCA, and PMA (samples—before washing, after one water wash, and after five launderings).

Sample Compound #6 (20% add-on) with TMPA and BTCA (samples—before washing, after one water wash, and after five launderings).

Sample Compound #5 (40% add-on) with TMPA, BTCA, and PMA (samples—after one water wash).

Percent Phosphorus Determinations on Selected Fabric Samples

| Sample Identification (dry add-on weights) | Before Washing (% P) | After 1 Water Wash (% P) | After 5 launderings (% P) |
|---|---|---|---|
| 20% FR #3, 5.0% BTCA, 2.5% $NaH_2PO_2$ | 2.8 | 1.9 | 1.6 |
| 20% FR #3, 8.0% TMPA, 4.0% $NaH_2PO_2$ | 3.6 | 2.1 | 2.1 |
| 20% FR #4, 5.0% BTCA, 2.5% $NaH_2PO_2$ | 3.4 | 2.0 | 2.1 |
| 20% FR #4, 8.0% TMPA, 4.0% $NaH_2PO_2$ | 4.2 | 2.7 | 2.5 |
| 20% FR #4, 8.0% PMA, 4.0% $NaH_2PO_2$ | 3.9 | 2.2 | 2.3 |
| 20% FR #6, 5.0% BTCA, 2.5% $NaH_2PO_2$ | 3.9 | 2.6 | 2.3 |
| 20% FR #6, 8.0% TMPA, 4.0% $NaH_2PO_2$ | 4.5 | 1.5 | 1.5 |
| 40% FR #5, 5.0% BTCA, 2.5% $NaH_2PO_2$ | — | 0.35 | — |
| 40% FR #5, 8.0% TMPA, 4.0% $NaH_2PO_2$ | — | 0.37 | — |
| 40% FR #5, 8.0% PMA, 4.0% $NaH_2PO_2$ | — | 0.34 | — |

Percent Sodium Determinations on Selected Fabric Samples

| Sample Identification (dry add-on weights) | After 5 launderings (% Na) |
|---|---|
| 20% FR #3, 5.0% BTCA, 2.5% $NaH_2PO_2$ | 72 ppm* |
| 20% FR #3, 8.0% TMPA, 4.0% $NaH_2PO_2$ | 58 ppm* |
| 20% FR #4, 5.0% BTCA, 2.5% $NaH_2PO_2$ | 55 ppm* |

-continued

| | |
|---|---|
| 20% FR #4, 8.0% TMPA, 4.0% $NaH_2PO_2$ | 95 ppm* |
| 20% FR #4, 8.0% PMA, 4.0% $NaH_2PO_2$ | 92 ppm* |
| 20% FR #6, 5.0% BTCA, 2.5% $NaH_2PO_2$ | 51 ppm* |
| 20% FR #6, 8.0% TMPA, 4.0% $NaH_2PO_2$ | 76 ppm* |

*Numbers are blank corrected (sodium level in blank was ~75 ppm)

As can be seen from the results above, several of the FR/resin application mixtures resulted in FR durability even after five launderings (the maximum number of washings that were used) with detergent. Given the above reported successful runs and the other tested embodiments that did not give the desired results either due to a lack of fire retardant reactivity (insufficient hydroxyl functionality) or to the volatility of the flame retardant additive, one trend became very clear. The presence of OH functionality in the flame retardant additive is needed to achieve the most satisfactory FR durability. Application mixtures containing Sample Compounds #3, #4, and #6 (OH-functional) resulted in the most durable FR treatments recorded.

Based on OH functionality, it seemed very likely that Sample Compound #5 would turn out to be the most durable FR additive evaluated. However, this was not the case during the experiments that were performed. The most likely explanation for this is that the FR additive vaporized during the oven curing stage. This was not surprising since the TGA and DSC analytical results for Compound #5 showed a significant weight loss (TGA & DSC) around 160° C., about twenty degrees below the set curing temperature (180° C.). Volatilization would also explain the large amount of smoke and vapor observed during the curing step of treated fabric. Given these results, the volatility of the selected FR additive (s) also needs to be considered when practicing the invention. Potential FR additives should have a substantially non-volatile, reactive component at the curing temperature to ensure cross-linking takes place before volatilization of the FR additive. The curing temperature is defined as the temperature at which the cross-linking reaction takes place.

In addition to the types of FR additives used, several observations were also made regarding the type of cross-linking resin used. Out of the various characteristics noted during the trials, the color and hand of the fabric samples were the most important. In general, the BTCA resin gave the softest hand and whitest color, both very desirable qualities. PMA and TMPA however gave less preferred results. As a general rule, the hand imparted by both resins was much stiffer than with BTCA, a property likely caused by the higher resin levels used. Either by reducing the add-on of these resins or by using softeners, the hand of the fabrics should improve. Another negative aspect of PMA and TMPA was the color they imparted on the fabric. The PMA-treated fabric developed a slight yellow tint. A quality that may be reduced by lowering the curing temperature and/or the addition of a whitening agent, two techniques commonly used in the industry to remedy this type of problem. In addition to PMA, TMPA also colored the fabric. However, the pink color produced by this resin was much more intense and noticeable.

During these initial trials, all but one of the fabric samples using Sample Compounds #3, #4, and #6 retained 56–68% of the applied phosphorus after one water wash. In addition, the phosphorus that did adhere to the fabric through the first wash seemed to remain there throughout all five launderings.

In addition to percent phosphorus determinations, it was also decided to confirm the level of sodium in the laundered samples. A high level of sodium would reflect badly on the long-term durability of the FR treatments tested. It is a well known fact that the hydrolysis and subsequent ion exchange of sodium into a phosphorus FR treatment from detergent significantly affects the FR performance of the treatment over time (i.e., sodium salts of phosphorus esters make poor FRs). Other than hydrolysis and removal of phosphorus from a fabric, the ion exchange of sodium into a FR treatment is one of the leading causes of FR performance loss after laundering. As the data above shows, all of the laundered samples contained very low levels of sodium, a good indication that the bonded phosphorus is stable to laundering and should retain good FR properties well after five washings.

The foregoing Example should not be construed in a limiting fashion since they are only intended to set forth certain preferred embodiments of the present invention. The scope of protection sought is set forth in the Claims that follow.

We claim:

1. An aqueous finishing composition for application to materials comprising cellulose, comprising a hydroxyalkyl-functional organophosphorus ester flame retardant and a non-formaldehyde cross-linking agent.

2. A composition as claimed in claim 1 that further comprises up to about 10%, by weight of the composition, of a cross-linking catalyst.

3. A composition as claimed in claim 1 that further comprises at least one saturated alpha-hydroxypolycarboxylic acid, and/or salt thereof, having at least two carboxyl groups bonded to adjacent carbons.

4. A composition as claimed in claim 1 wherein the hydroxyalkyl-functional organophosphorus ester flame retardant has a substantially non-volatile, reactive component at the curing temperature.

5. A composition as claimed in claim 4 wherein the organophosphorus flame retardant is selected from the group consisting of oligomeric phosphate, polymeric phosphate, oligomeric phosphonate, or mixed phosphate/phosphonate ester flame retardant compositions.

6. A composition as claimed in claim 5 wherein the hydroxyalkyl-functional organophosphorus ester flame retardant has the following structure:

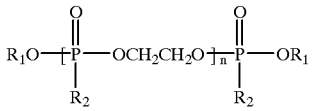

where $R_1$ is independently selected from alkyl and hydroxyalkyl, $R_2$ is independently selected from alkyl, alkenyl, alkoxy, and hydroxyalkoxy, and n is equal to or greater than 1.

7. A composition as claimed in claim 6 wherein the hydroxyalkyl-functional organophosphorus ester flame retardant has the following structure:

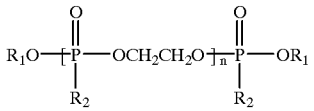

where $R_1$ in independently selected from methyl and hydroxyethyl, $R_2$ is independently selected from methyl, methoxy, and hydroxyethoxy, and n in equal to or greater than 1.

8. A composition as claimed in claim 1 wherein the non-formaldehyde cross-linking agent is selected from the group consisting of a polycarboxylic acid, a polycarboxylic acid salt, and mixtures thereof having one or more dicarboxylic groups on adjacent carbon atoms, optionally containing phosphorus.

9. A composition as claimed in claim 8 wherein the polycarboxylic acid cross-linking agent is 1,2,3,4-butanetetracarboxylic acid.

10. A composition as claimed in claim 8 wherein the polycarboxylic acid cross-linking agent is polymaleic acid.

11. An aqueous finishing composition for application to a material comprising cellulose that comprises from about 1% to about 60%, by weight of the composition, of a non-volatile, hydroxyalkyl-functional organophosphorus ester flame retardant and from about 1% to about 40%, by weight of the composition, of a non-formaldehyde cross-linking agent.

12. A composition as claimed in claim 11 that further comprises up to about 30%, by weight of the composition, of a cross-linking catalyst.

13. A composition as claimed in claim 11 wherein the hydroxyalkyl-functional organophosphorus ester flame retardant has a substantially non-volatile, reactive component at the curing temperature.

14. A composition as claimed in claim 13 wherein the hydroxyalkyl-functional organophosphorus ester flame retardant is a hydroxyalkyl-functional oligomeric and/or polymeric phosphate, phosphonate, or mixed phosphate/phosphonate ester flame retardant product.

15. A composition as claimed in claim 14 wherein the hydroxyalkyl-functional organophosphorus flame retardant has the following structure:

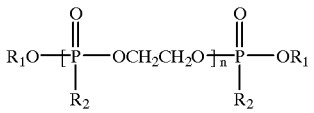

where $R_1$ is independently selected from alkyl and hydroxyalkyl, $R_2$ is independently selected from alkyl, alkenyl, alkoxy, and hydroxyalkoxy, and n in equal to or greater than 1.

16. A composition as claimed in claim 15 wherein the hydroxyalkyl-functional organophosphorus flame retardant has the following structure:

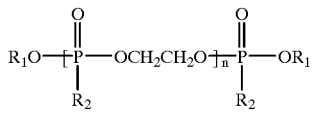

where $R_1$ is independently selected from methyl and hydroxyethyl, $R_2$ is independently selected from methyl, methoxy, and hydroxyethoxy, and n is equal to or greater than 1.

17. A composition as claimed in claim 11 wherein the non-formaldehyde cross-linking agent is selected from the group consisting of a polycarboxylic acid, a polycarboxylic acid salt, and mixtures thereof having one or more dicarboxylic groups on adjacent carbon atoms, optionally containing phosphorus.

18. A composition as claimed in claim 17 wherein the polycarboxylic acid cross-linking agent is 1,2,3,4-butanetetracarboxylic acid.

19. A composition as claimed in claim 17 wherein the polycarboxylic acid cross-linking agent is polymaleic acid.

* * * * *